US009808062B2

(12) United States Patent
Williams

(10) Patent No.: US 9,808,062 B2
(45) Date of Patent: Nov. 7, 2017

(54) HAIR STYLING DEVICE

(71) Applicant: Alexis Williams, Arlington, TX (US)

(72) Inventor: Alexis Williams, Arlington, TX (US)

( * ) Notice: Subject to any disclaimer, the term of this patent is extended or adjusted under 35 U.S.C. 154(b) by 0 days.

(21) Appl. No.: 14/603,471

(22) Filed: Jan. 23, 2015

(65) Prior Publication Data

US 2016/0213116 A1 Jul. 28, 2016

(51) Int. Cl.

| | |
|---|---|
| ***A45D 2/40*** | (2006.01) |
| ***A45D 1/04*** | (2006.01) |
| ***A45D 1/12*** | (2006.01) |

(52) U.S. Cl.

CPC *A45D 1/04* (2013.01); *A45D 1/12* (2013.01)

(58) Field of Classification Search

CPC ... A45D 1/00; A45D 1/04; A45D 1/12; A45D 1/14; A45D 1/16

See application file for complete search history.

(56) References Cited

U.S. PATENT DOCUMENTS

| | | | | |
|---|---|---|---|---|
| 564,955 | A | 7/1896 | Brunswick | |
| 1,636,212 | A * | 7/1927 | Browne | 132/225 |
| 4,233,999 | A | 11/1980 | Thomas | |
| 4,267,431 | A | 5/1981 | Rick et al. | |
| 4,591,695 | A | 5/1986 | Inone | |
| 4,829,156 | A | 5/1989 | Thompson | |
| 7,045,744 | B2 | 5/2006 | Oh | |
| 7,082,949 | B2 | 8/2006 | Julemont | |
| D626,749 | S | 11/2010 | Ragosta et al. | |
| 2003/0000542 | A1 * | 1/2003 | Huntley | 132/232 |
| 2006/0278251 | A1 * | 12/2006 | Hur | A45D 1/04 132/232 |
| 2008/0173322 | A1 * | 7/2008 | Leung | 132/232 |
| 2011/0061672 | A1 * | 3/2011 | Schmider | 132/226 |
| 2014/0034079 | A1 * | 2/2014 | McCauley | 132/229 |

* cited by examiner

*Primary Examiner* — Rachel Steitz

(74) *Attorney, Agent, or Firm* — Law Office of Jeff Williams; J. Oliver Williams

(57) ABSTRACT

A hair styling device simplifies the task of curling a person's hair. The device includes a first heating element extending from the first end of a handle. The first heating element is elongated and spiral defining a first plurality of spaced coils. A pivot arm coupled to the handle is pivotable between a closed position and a pivoted position. A second heating element extends from a primary end of the pivot arm. The second heating element is elongated and spiral defining a second plurality of spaced coils. The second plurality of spaced coils is interlaced and substantially co-linear with the first plurality of coils when the pivot arm is in the closed position. The second heating element pivots away from the first heating element when the pivot arm is pivoted into the pivoted position.

14 Claims, 4 Drawing Sheets

HAIR STYLING DEVICE

BACKGROUND OF THE DISCLOSURE

Field of the Disclosure

The disclosure relates to heated hairstyling devices and more particularly pertains to a new heated hairstyling device for simplifying the task of curling a person's hair.

SUMMARY OF THE DISCLOSURE

An embodiment of the disclosure meets the needs presented above by generally comprising a first heating element extending from the first end of a handle. The first heating element is elongated and spiral defining a first plurality of spaced coils. A pivot arm coupled to the handle is pivotable between a closed position and a pivoted position. A second heating element extends from a primary end of the pivot arm. The second heating element is elongated and spiral defining a second plurality of spaced coils. The second plurality of spaced coils is interlaced and substantially co-linear with the first plurality of coils when the pivot arm is in the closed position. The second heating element pivots away from the first heating element when the pivot arm is pivoted into the pivoted position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
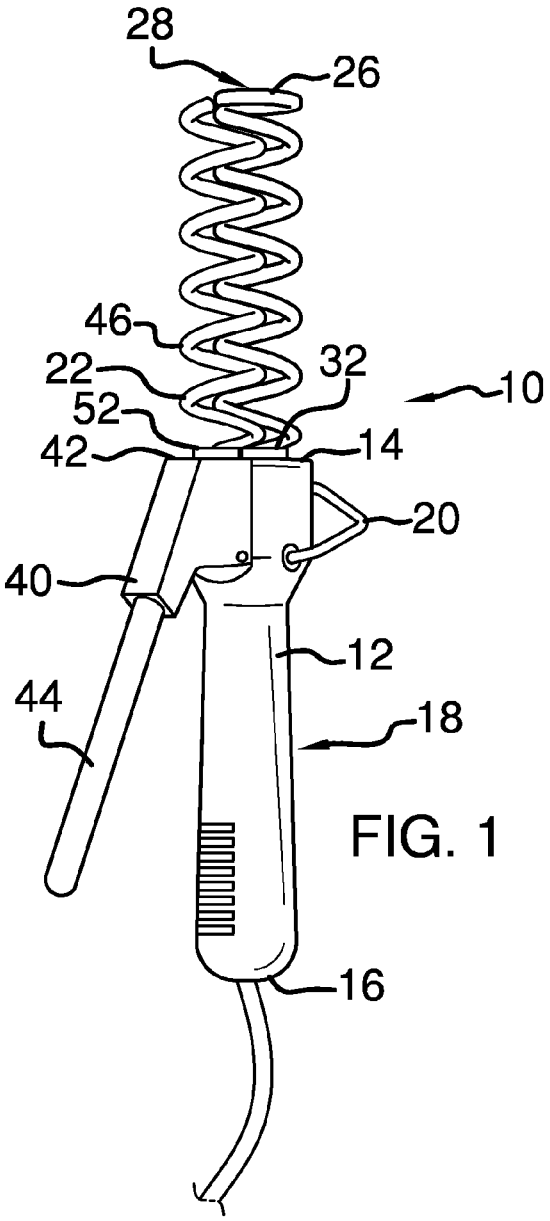
FIG. 1 is a top front side perspective view of a hair styling device according to an embodiment of the disclosure showing the rods in a closed position.
Figure 2:
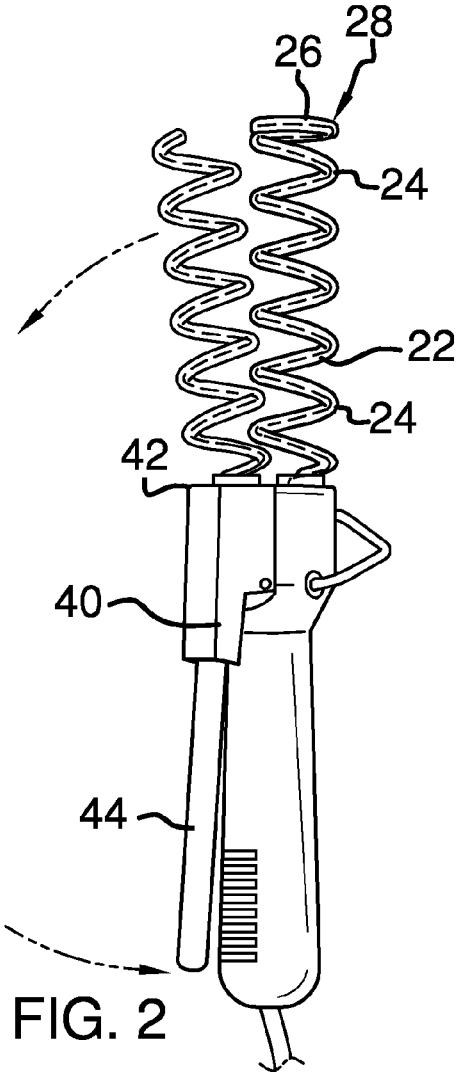
FIG. 2 is a top front side perspective view of an embodiment of the disclosure showing the rods in an open position.
Figure 3:
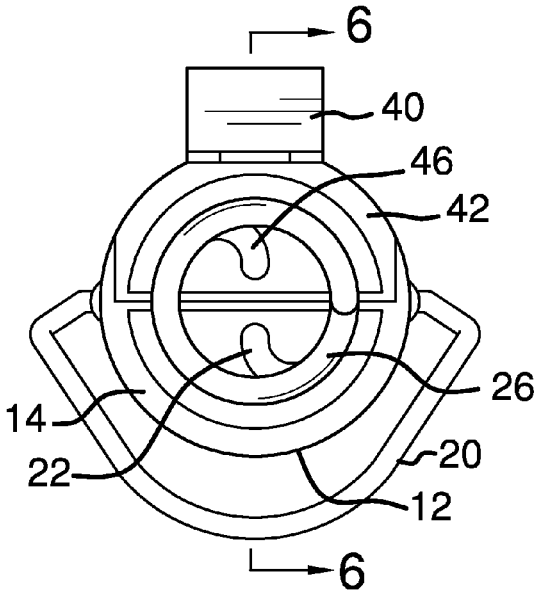
FIG. 3 is a top view of an embodiment of the disclosure.
Figure 4:
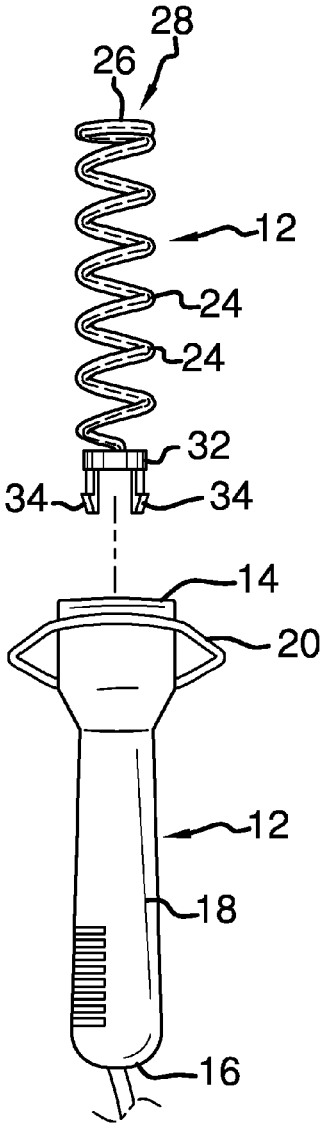
FIG. 4 is a top front side perspective view of an alternative embodiment of the disclosure.
Figure 5:
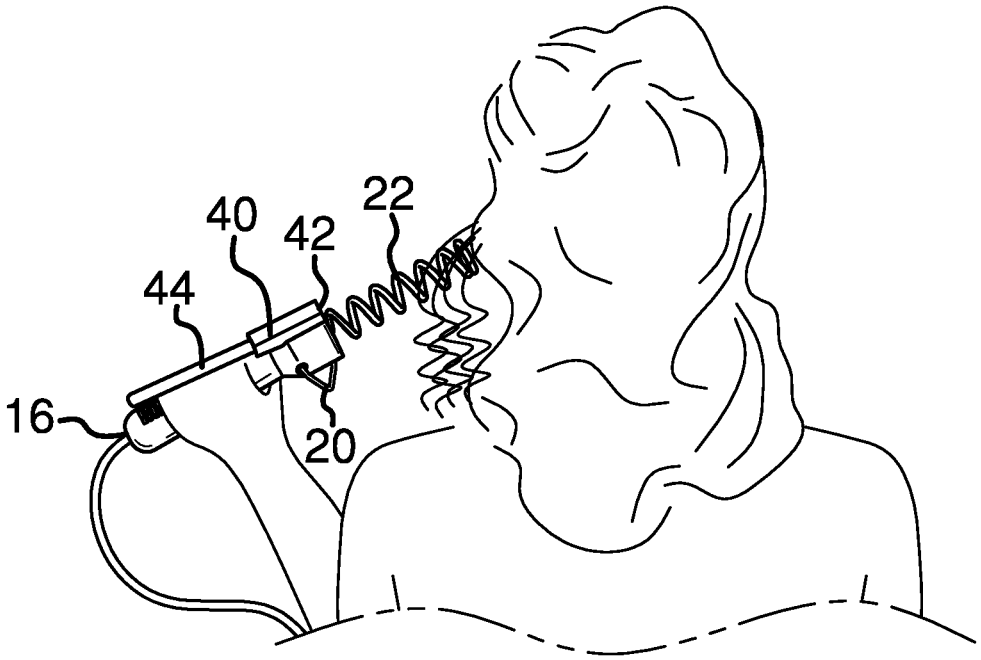
FIG. 5 is an in-use view of an alternative embodiment of the disclosure.
Figure 6:
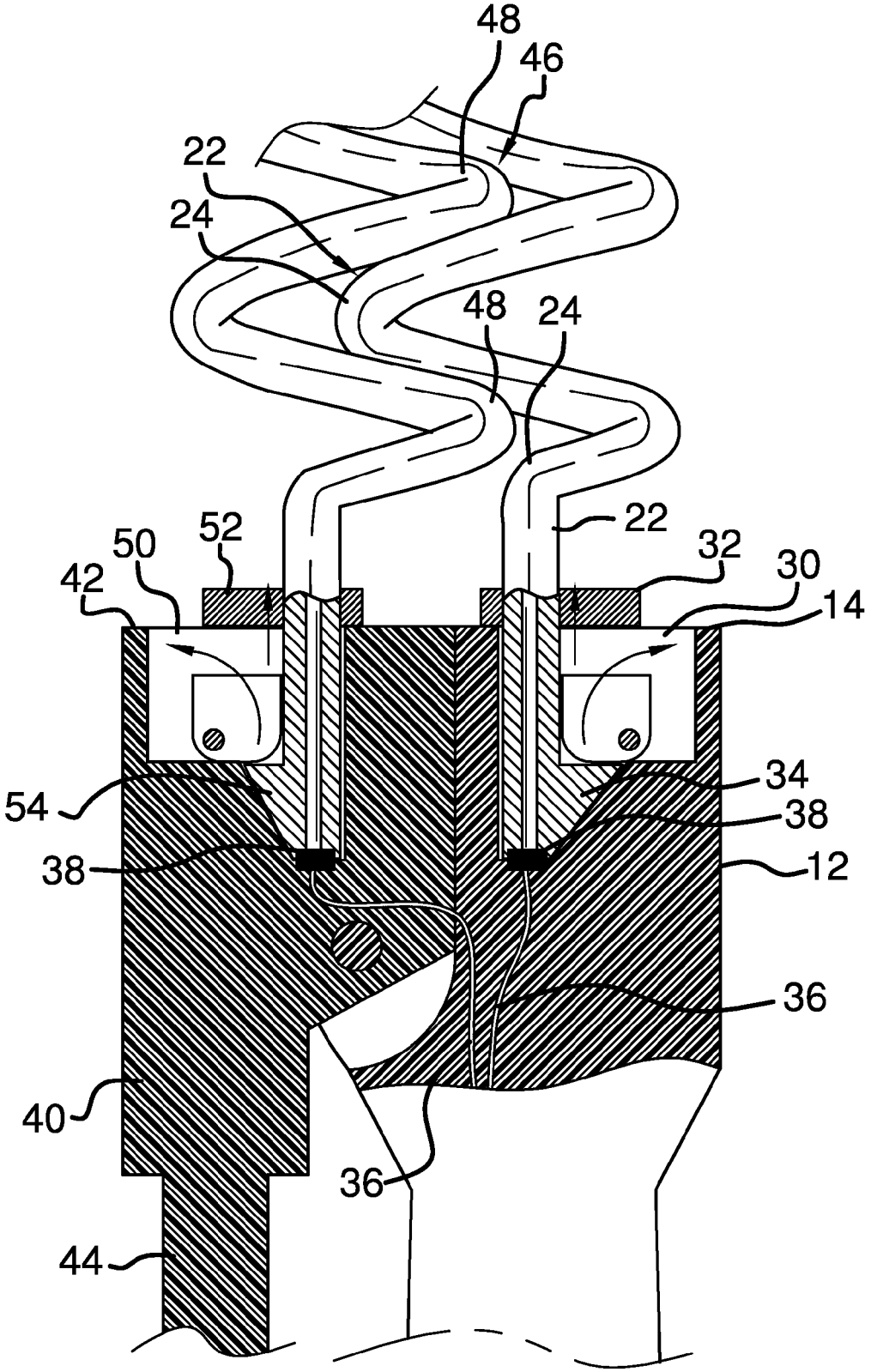
FIG. 6 is a cross-sectional view on an embodiment of the disclosure taken along line 6-6 of FIG. 3.

With reference now to the drawings, and in particular to FIGS. 1 through 6 thereof, a new heated hairstyling device embodying the principles and concepts of an embodiment of the disclosure and generally designated by the reference numeral 10 will be described.

As best illustrated in FIGS. 1 through 6, the hair styling device 10 generally comprises a handle 12 having a first end 14 and a second end 16. The handle 12 is elongated between the first end 14 and the second end 16. The handle 12 comprises a grip section 18 extending from the second end 16 of the handle 12 towards the first end 14 of the handle 12. The grip section 18 tapers extending towards the first end 14 of the handle 12 from the second end 16 of the handle 12. A stand 20 is coupled to the handle 12 to support the first end 14 in a raised position when the handle 12 is set on a supporting surface.

A first heating element 22 is coupled to the handle 12. The first heating element 22 extends from the first end 14 of the handle 12. The first heating element 22 is elongated. The first heating element 22 is spiral defining a first plurality of spaced coils 24 and forming a ring 26 at a distal end 28 of the first heating element 22 relative to the handle 12. The each of the coils 24 is evenly spaced and equidistant from a linear axis of the spiral. A primary socket 30 extends into the first end 14 of the handle 12. The first heating element 22 is removably coupled to the primary socket 30. This is achieved using a primary base 32 matingly coupleable to the primary socket 30. The first heating element 22 is coupled to and extends from the primary base 32. The primary base 32 is in a static position relative to the handle 12 when the primary base 32 is coupled to the primary socket 30. Each of a pair of spaced prongs 34 is coupled to and extends from the primary base 32. Each of the prongs 34 is inserted into the primary socket 30 and releasably engages the handle 12 wherein the primary base 32 is removable from the handle 12. Wiring 36 and contacts 38 are provided to deliver current into the first heating element 22 in a conventional manner.

A pivot arm 40 is pivotally coupled to the handle 12. The pivot arm 40 is pivotable between a closed position and a pivoted position. The pivot arm 40 has a primary end 42 positioned adjacent to the first end 14 of the handle 12. The pivot arm 40 has an elongated trigger section 44. The trigger section 44 extends along the handle 12 proximate the grip section 18 wherein the trigger section 44 is configured to be squeezed by fingers of a hand grasping the grip section 18. A second heating element 46 is coupled to the pivot arm 40. The second heating element 46 extends from the primary end 42 of the pivot arm 40. The second heating element 46 is elongated and spiral defining a second plurality of spaced coils 48. The second plurality of spaced coils 48 is interlaced and substantially co-linear with the first plurality of coils 24 when the pivot arm 40 is in the closed position. The second heating element 46 pivots away from the first heating element 22 when the pivot arm 40 is pivoted into the pivoted position. A second socket 50 extends into the primary end 42 of the pivot arm 40. A second base 52 is matingly couplable to the second socket 50. Each of a pair of spaced tines 54 is coupled to and extends from the second base 52. Each of the tines 54 is inserted into the second socket 50 and releasably engages the pivot arm 40 wherein the second base 52 is removable from the pivot arm 40. Wiring and contacts are provided in the pivot arm 40 in a conventional manner to provide current to the second heating element 46.

In use, the first heating element 22 and second heating element 46 are attached to the handle 12 and pivot arm 40 respectively. Current is provided to heat each of the first heating element 22 and the second heating element 46. The handle 12 may be supported on the stand 20 which holds the first heating element 22 and second heating element 46 in spaced relationship to the supporting surface. When sufficiently heated, the handle 12 is grasped and the pivot arm 40 pivoted to separate the second heating element 46 from being interlaced with the first heating element 22. The handle is then manipulated to engage hair into the coils 24 of the first heating element 22. The pivot arm 40 is released to interlace the coils 48 of the second heating element 46 with the coils 24 of the first heating element 22. The hair may be styled by repeating this process as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hair styling device comprising:

a handle having a first end and a second end;

a first heating element being coupled to said handle, said first heating element extending from said first end of said handle, said first heating element being elongated, said first heating element being spiral defining a first plurality of spaced coils;

a pivot arm pivotally coupled to said handle, said pivot arm being pivotable between a closed position and a pivoted position, said pivot arm having a primary end positioned adjacent to said first end of said handle; and a second heating element being coupled to said pivot arm, said second heating element extending from said primary end of said pivot arm, said second heating element being elongated, said second heating element being spiral defining a second plurality of spaced coils, said second plurality of spaced coils being interlaced and substantially co-linear with said first plurality of coils when said pivot arm is in said closed position, said second heating element pivoting away from said first heating element when said pivot arm is pivoted into said pivoted position;

wherein said first plurality of spaced coils being independent from said second plurality of spaced coils, each forming an independent helix shape.

2. The device of claim 1, further comprising a primary socket extending into said first end of said handle, said first heating element being removably coupled to said primary socket.

3. The device of claim 2, further comprising a primary base being matingly coupleable to said primary socket, said first heating element being coupled to and extending from said primary base.

4. The device of claim 3, further comprising said primary base being in a static position relative to said handle when said primary base is coupled to said primary socket.

5. The device of claim 3, further comprising a pair of spaced prongs coupled to and extending from said primary base, each of said prongs being inserted into said primary socket and releasably engaging said handle wherein said primary base is removable from said handle.

6. The device of claim 1, further comprising said first heating element forming a ring at a distal end of said first heating element relative to said handle.

7. The device of claim 1, further comprising a second socket, said second socket extending into said primary end of said pivot arm.

8. The device of claim 7, further comprising a second base, said second base being matingly couplable to said second socket.

9. The device of claim 7, further comprising a pair of spaced tines coupled to and extending from said second base, each of said tines being inserted into said second socket and releasably engaging said pivot arm wherein said second base is removable from said pivot arm.

10. The device of claim 1, further comprising a stand coupled to said handle.

11. The device of claim 1, further comprising said handle being elongated, said handle comprising a grip section extending from said second end of said handle towards said first end of said handle.

12. The device of claim 11, further comprising said grip section tapering extending towards said first end of said handle.

13. The device of claim 11, further comprising said pivot arm having an elongated trigger section, said trigger section extending along said handle proximate said grip section wherein said trigger section is configured to be squeezed by fingers of a hand grasping said grip section.

14. A hair styling device comprising:

a handle having a first end and a second end, said handle being elongated, said handle comprising a grip section extending from said second end of said handle towards said first end of said handle, said grip section tapering extending towards said first end of said handle;

a stand coupled to said handle;

a first heating element being coupled to said handle, said first heating element extending from said first end of said handle, said first heating element being elongated, said first heating element being spiral defining a first plurality of spaced coils in a helix formation, said first heating element forming a ring at a distal end of said first heating element relative to said handle;

a primary socket extending into said first end of said handle, said first heating element being removably coupled to said primary socket;

a primary base being matingly coupleable to said primary socket, said first heating element being coupled to and extending from said primary base, said primary base being in a static position relative to said handle when said primary base is coupled to said primary socket;

a pair of spaced prongs coupled to and extending from said primary base, each of said prongs being inserted into said primary socket and releasably engaging said handle wherein said primary base is removable from said handle;

a pivot arm pivotally coupled to said handle, said pivot arm being pivotable between a closed position and a pivoted position, said pivot arm having a primary end positioned adjacent to said first end of said handle, said pivot arm having an elongated trigger section, said trigger section extending along said handle proximate said grip section wherein said trigger section is configured to be squeezed by fingers of a hand grasping said grip section;

a second heating element being coupled to said pivot arm, said second heating element extending from said primary end of said pivot arm, said second heating element being elongated, said second heating element being spiral defining a second plurality of spaced coils in a helix formation, said second plurality of spaced coils being interlaced and substantially co-linear with said first plurality of coils when said pivot arm is in said closed position, said second heating element pivoting away from said first heating element when said pivot arm is pivoted into said pivoted position;

a second socket, said second socket extending into said primary end of said pivot arm;

a second base, said second base being matingly couplable to said second socket; and a pair of spaced tines coupled to and extending from said second base , each of said tines being inserted into said second socket and releasably engaging said pivot arm wherein said second base is removable from said pivot arm.

* * * * *